US008810121B1

(12) United States Patent
Maier, II et al.

(10) Patent No.: US 8,810,121 B1
(45) Date of Patent: Aug. 19, 2014

(54) METHOD AND DEVICE TO PRODUCE HOT, DENSE, LONG-LIVED PLASMAS

(71) Applicants: William Bryan Maier, II, Marina, CA (US); Eugene Ellis Nolting, Columbia, MD (US); Donald D. Snyder, Monterey, CA (US)

(72) Inventors: William Bryan Maier, II, Marina, CA (US); Eugene Ellis Nolting, Columbia, MD (US); Donald D. Snyder, Monterey, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 180 days.

(21) Appl. No.: 13/656,384

(22) Filed: Oct. 19, 2012

Related U.S. Application Data

(60) Provisional application No. 61/554,362, filed on Nov. 1, 2011.

(51) Int. Cl.
*H05H 1/24* (2006.01)

(52) U.S. Cl.
CPC ..... *H05H 1/24* (2013.01)
USPC ..... 313/231.31; 89/8

(58) Field of Classification Search
USPC ..... 313/231.31; 89/8
See application file for complete search history.

(56) References Cited

U.S. PATENT DOCUMENTS

| | | | |
|---|---|---|---|
| 667,435 | A | 2/1901 | Friese-Greene et al. |
| 4,715,261 | A | 12/1987 | Goldstein et al. |
| 4,913,029 | A | 4/1990 | Tidman et al. |
| 5,005,484 | A | 4/1991 | Witt |
| 5,042,359 | A | 8/1991 | Witt et al. |
| 5,094,141 | A | 3/1992 | Zwingel et al. |
| 5,331,879 | A | 7/1994 | Loffler |
| 5,612,506 | A | 3/1997 | Goldstein |

OTHER PUBLICATIONS

Sivkov, A.A., "Hybrid Electromagnetic System for Acceleration of Solids." Journal of Applied Mechanics and Technical Physics, vol. 42, pp. 1-9, 2001.

*Primary Examiner* — Anh Mai
*Assistant Examiner* — Brenitra M Lee
(74) *Attorney, Agent, or Firm* — Naval Postgraduate School; Lisa A. Norris

(57) ABSTRACT

A device and method to produce a hot, dense, long-lived plasma. In one embodiment, a large electric current is passed through an outer tube enclosing in part a piston, a notched conducting rod and central electrode. Electromagnetic forces accelerate the piston to a point high enough to mechanically separate the conducting rod at the location of the notch before the conducting rod is melted. On separation, a plasma is generated by the passage of electric current though a gas produced by vaporization of the conducting rod and nearby materials. An insulator enclosed within the tube prevents the plasma from shorting to the outer tube until the current flow has produced a sufficient magnetic field to contain the plasma. The piston is then accelerated by a combination of electromagnetic forces and mechanical pressure from the hot gas through which the electric current is passing.

2 Claims, 8 Drawing Sheets

METHOD AND DEVICE TO PRODUCE HOT, DENSE, LONG-LIVED PLASMAS

CROSS-REFERENCE TO RELATED APPLICATIONS

This application claims the benefit of U.S. Provisional Application No. 61/554,362 filed Nov. 1, 2011, which is hereby incorporated in its entirety by reference.

BACKGROUND OF THE INVENTION

1. Field of the Invention

The present invention relates generally to production of plasmas.

2. Description of the Related Art

High-temperature, high-pressure plasmas have many potential uses but can be hard to control. For example, arc welding uses thermal plasma arcs at around 1 Atm pressure and a few thousand degrees K temperature. In arc welding the plasma arc is very short and tends to walk on the node surface. Attempts to stabilize very high-temperature plasma arcs for use in nuclear fusion have not yet succeeded in a commercial way, despite decades of research. Large magnetic confinement devices and laser compression of pellets (inertial confinement), such as at the National Ignition Facility (NIF), are still searching for a plasma having sufficient density, temperature, and lifetime to produce enough fusion of deuterium and tritium (D and T) to be commercially viable. The root problem is that dense, high-temperature, high-pressure plasmas develop instabilities in a very short time that cause plasma growth in unpredictable directions.

A measure of plasma stability, temperature, and density is nTt, where n is number density of molecules and atoms in the plasma, T is plasma temperature, and t is lifetime of the stable plasma. Plasmas having large nTt are hard to obtain.

A. A. Sivkov reported formation of a plasma arc in "Hybrid Electromagnetic System for Acceleration Solids," *Journal of Applied Mechanics and Technical Physics*, Vol. 42, No. 1 (2001), pp. 1-9. The plasma arc in Sivkov was formed by the thermally induced explosion of small wires and by a longitudinal magnetic field that formed the debris through which the current passed into an arc and plasma bridge. In Sivkov, a plasma column to return the current was formed by electromagnetic processes some time after the wires exploded.

SUMMARY OF THE INVENTION

Embodiments in accordance with the invention described herein generate a hot, dense, long-lived plasma along the central axis of an interior channel of a tube. In accordance with one embodiment, a device includes: a cylindrical metal tube having an outer diameter and an inner diameter and a central channel; a metal piston disposed within the central channel; a conducting central electrode, having a centrally formed cavity; a conducting rod having an encircling notch, where a first portion of the conducting rod is attached within the metal piston, a second portion of the conducting rod having the encircling notch extends between the metal piston and the central electrode, and a third portion of the conducting rod extends within the cavity of the central electrode such that a space is formed between the end of the third portion and the back of the cavity within the central electrode; and, an insulator disposed within the central channel and surrounding the conducting central electrode and the second portion of the conducing rod, wherein application of a current to the metal tube and the central electrode causes the conducting rod to break at the location of the notch with resultant generation of a hot, long-lived plasma along a central axis of the central channel.

In another embodiment, a method for generating a hot, dense, long-lived plasma by said device is also described.

Embodiments in accordance with the invention are best understood by reference to the following detailed description when read in conjunction with the accompanying drawings.

Embodiments in accordance with the invention are further described herein with reference to the drawings.

DETAILED DESCRIPTION OF THE INVENTION

As further described herein, embodiments in accordance with the invention initiate a very hot, dense, long-lived plasma along the central axis of the interior channel of a tube without requiring the application of a strong longitudinal magnetic field. Embodiments in accordance with the invention generate a plasma arc, also termed herein a plasma, almost the instant that mechanical forces break a conducting rod. In testing, example embodiments in accordance with the invention produced currents in excess of 100 kA, at pressures measured to be ≈1500-2000 Atm, for times ≈1 ms. Plasma temperatures are thought to be greater than 30,000 K.

Figure 1:
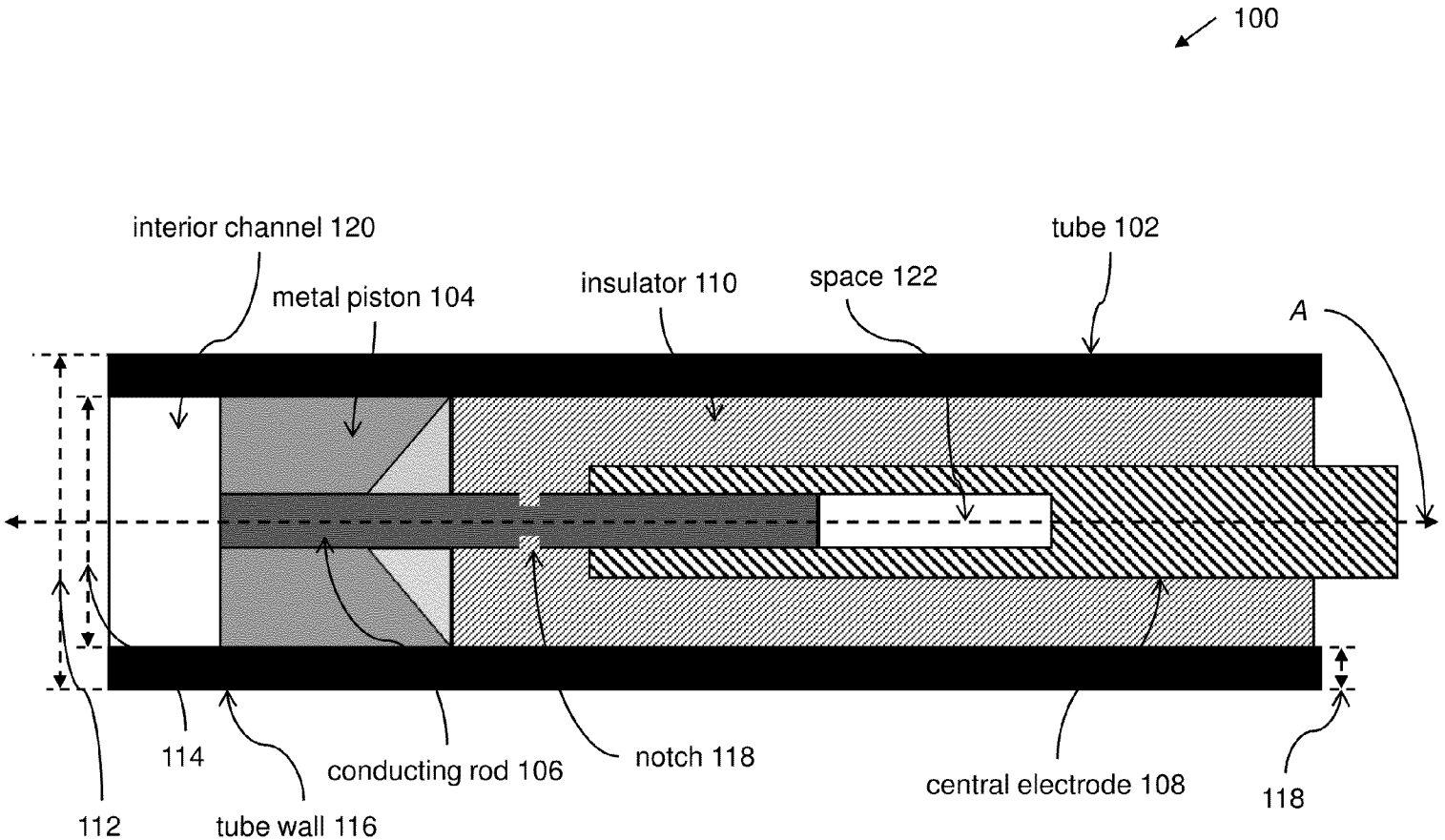
FIG. 1 illustrates a cross-sectional view of a schematic configuration of a motional plasma stabilizer device in accordance with one embodiment.

FIG. 1 illustrates a cross-sectional view of a schematic configuration of a motional plasma stabilizer device 100 in accordance with one embodiment. As illustrated in FIG. 1, motional plasma stabilizer 100 includes: a cylindrical metal tube 102; a metal piston 104; a conducting rod 106; a conducting central electrode 108; and an insulator 110. Not shown are current carrying attachments which couple tube 102 and central electrode 108 to a power supply capable of supplying several hundred kiloamperes of current. The power supply is connected to the current carrying attachments and when initiated, provides power to device 100 via the current carry attachments. Tube 102 has an exterior diameter 112 and interior diameter 114 resulting in tube wall 116 with a wall thickness 118 and an interior channel 120 of diameter 114 having a central axis shown as A. In one embodiment tube 102 is formed of one or more metals. The metal selected should be strong enough to withstand large pressures produced within channel 120. In one embodiment, metal piston 104 is formed of one or more metals which can be the same or different from the one or more metals forming tube 102.

Disposed within interior channel 120 is piston 104 which surrounds and is attached to conducting rod 106. In one embodiment, conducting rod 106 is formed of a conductive rod material and is notched around with a notch 118. The notching removes a portion of the conductive rod material from conducting rod 106. In one embodiment, notch 118 is used to facilitate the breakage of conducting rod 106 during operation of device 100.

In one embodiment a first portion of conducting rod 106 is seated in metal piston 104 and the remainder of conducting rod 106 extends from metal piston 104 through insulator 110 and partially into central electrode 108; in this configuration a central second portion of conducting rod 106 having notch 118 is surrounded by insulator 110 and a third portion of conducting rod 106 extends into central electrode 108. Central electrode 108 is formed of a conductive electrode material and has a central cavity formed though a portion of the conductive electrode material. The third portion of conducting rod 106 partially extends into the central cavity of central electrode 108 resulting in a space 122 between the end of the third portion of conducting rod 106 and the conductive electrode material of central electrode 108.

Figure 2:
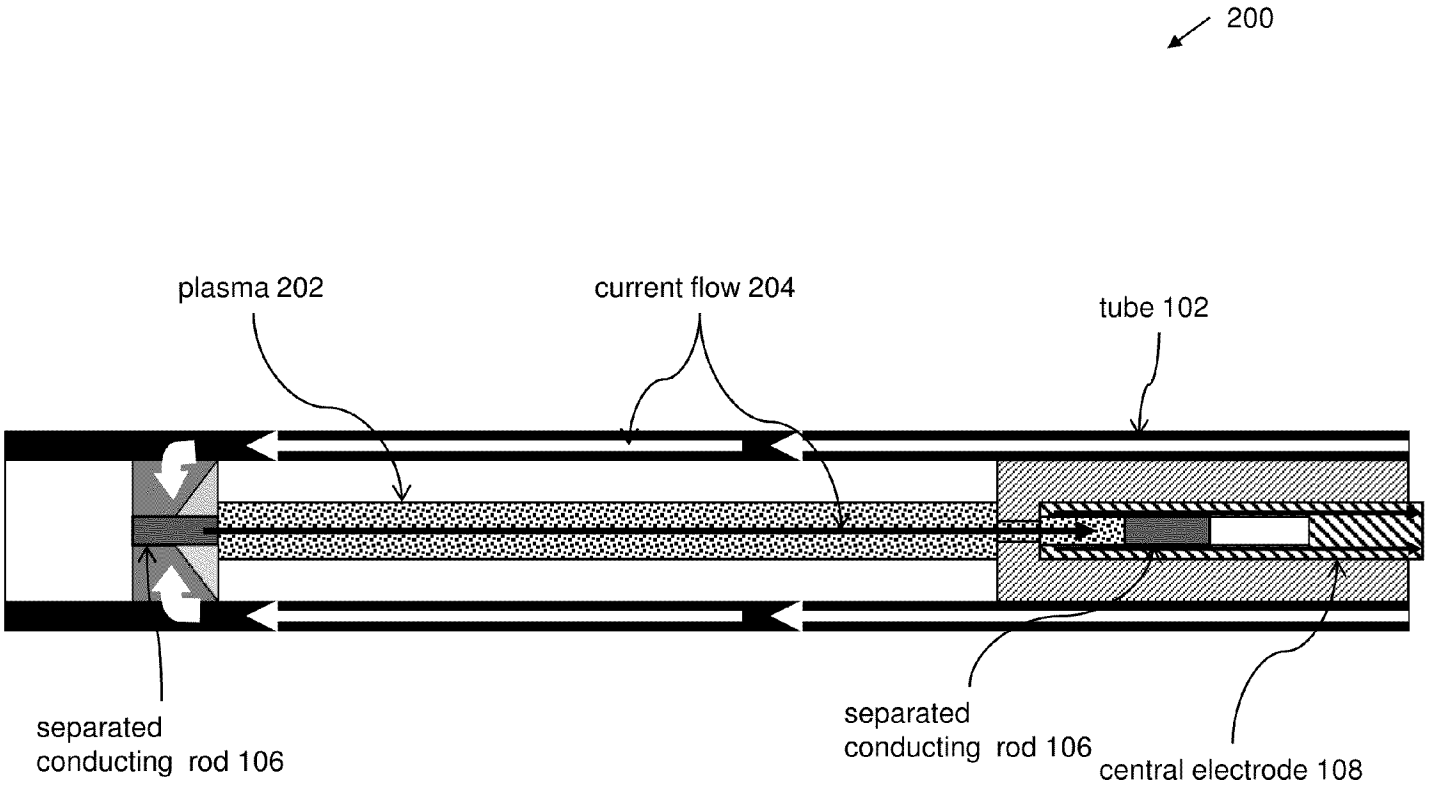
FIG. 2 illustrates a schematic depiction of current flow in the motional plasma stabilizer of FIG. 1 when the plasma is fully developed in accordance with one embodiment.

FIG. 2 illustrates a schematic depiction 200 of a current flow 204 in the motional plasma of FIG. 1 when a plasma 202 is fully developed in accordance with one embodiment. For clarity of description identifiers utilized in FIG. 1 are maintained in FIG. 2. In FIG. 2, application of current from an external power supply through current carrying attachments coupled to couple tube 102 and central electrode 108 results in generation of plasma 202 as further described with reference to FIGS. 3A-3E. The current passing through plasma 202, shown as current flow 204, produces an axial magnetic field. The axial magnetic field encircles, e.g., surrounds, plasma 202 and inhibits flow to tube 116 resulting in plasma 202 formed as a plasma column along the central axis of tube 102.

Figure 3A:
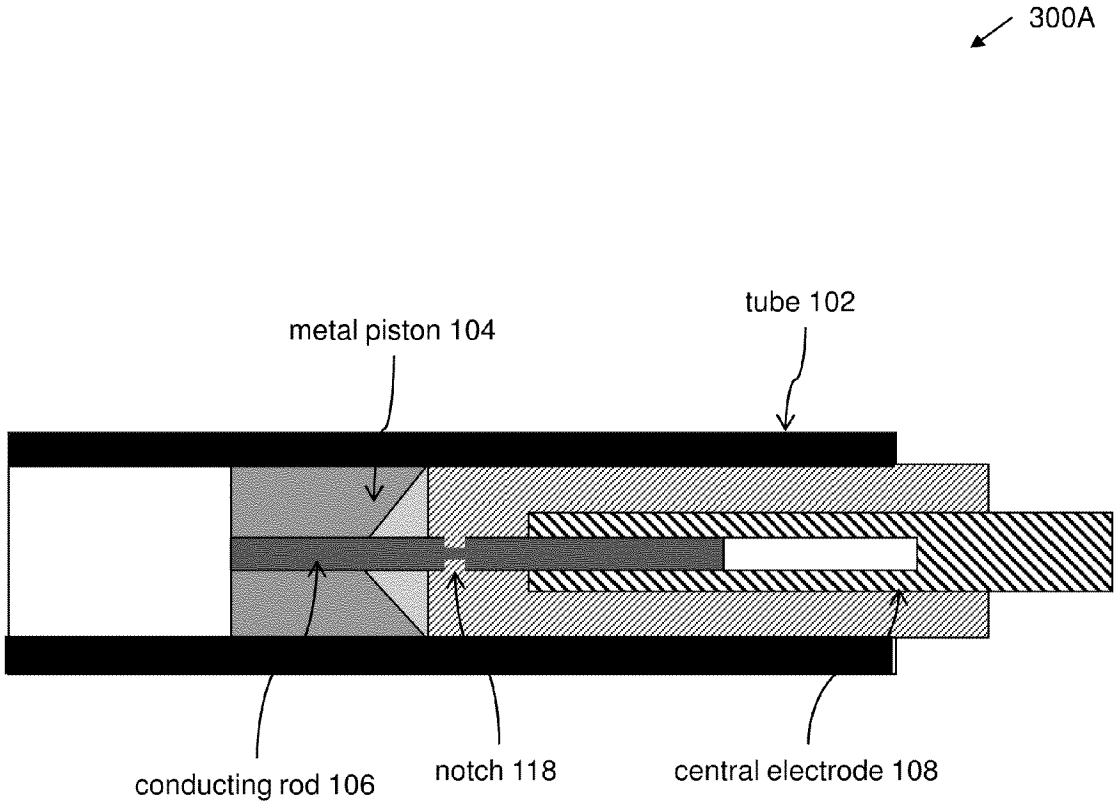
FIG. 3A illustrates piston initiation in accordance with one embodiment.
Figure 3B:
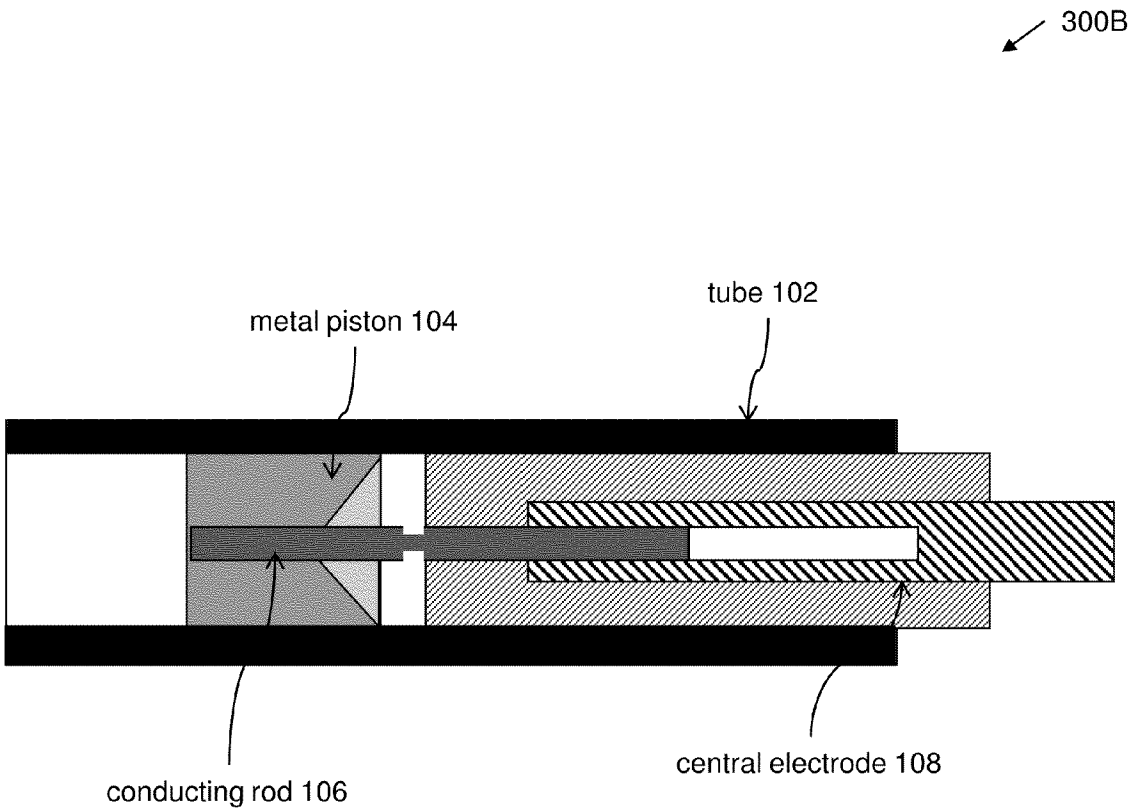
FIG. 3B illustrates piston movement and contact resistance changing in accordance with one embodiment.

FIGS. 3A-3E illustrate the inferred development of the plasma during operation of the device of FIG. 1 in accordance with one embodiment. FIG. 3A illustrates initiation of piston 104 movement within tube 102 in accordance with one embodiment. In FIG. 3A a large electric current is applied from the external power supply through the current carrying attachments to tube 102 and central electrode 108. The large electric current is passed through tube 102, piston 104, conducting rod 106, and central electrode 108 and movement of piston 104 is initiated. FIG. 3B illustrates piston 104 moving and contact resistance changing in accordance with one embodiment. In FIG. 3B electromagnetic forces accelerate piston 104. As piston 104 accelerates, the contact resistance begins changing.

Figure 3C:
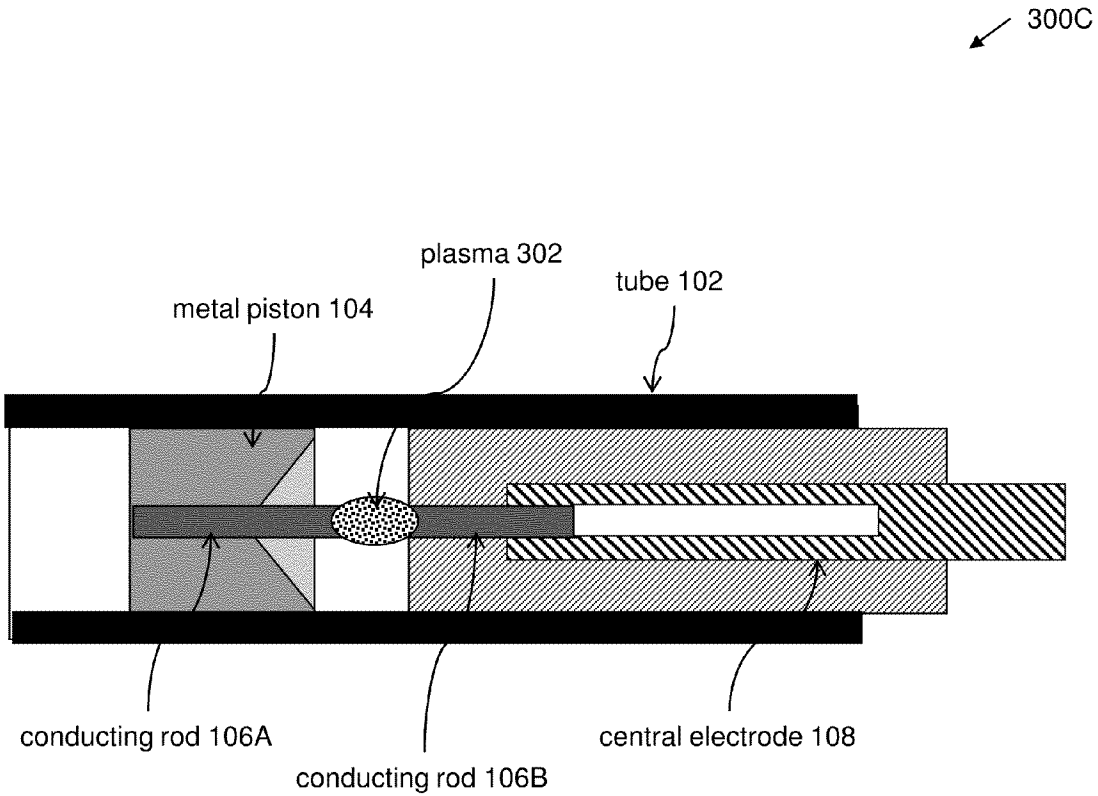
FIG. 3C illustrates separation of the conducting rod at the notch with a high density plasma forming as the conducting rod vaporizes in accordance with one embodiment.

FIG. 3C illustrates conducting rod 106 separating at notch 118 with a high density plasma 302 forming as conducting rod 106 vaporizes in accordance with one embodiment. In FIG. 3C electromagnetic acceleration of piston 104 increases high enough to mechanically separate conducting rod 106 before conducting rod 106 is melted by Joule heating. Notch 118 determines where conducting rod 106 separates and therefore where plasma 302 first forms. As shown in FIG. 3C, in one embodiment, conducting rod 106 separates into two portions 106A and 106B. Insulator 110 prevents plasma 302 from shorting to tube 102 until the current flow has produced a sufficient magnetic field to contain plasma 302. Plasma 302 is generated by the passage of electric current through the gas produced by vaporization of the material of the "tail" of conducting rod 106 and nearby materials. Piston 104 is then accelerated by a combination of electromagnetic forces and mechanical pressure from the hot gas through which the electric current is passing.

Figure 3D:
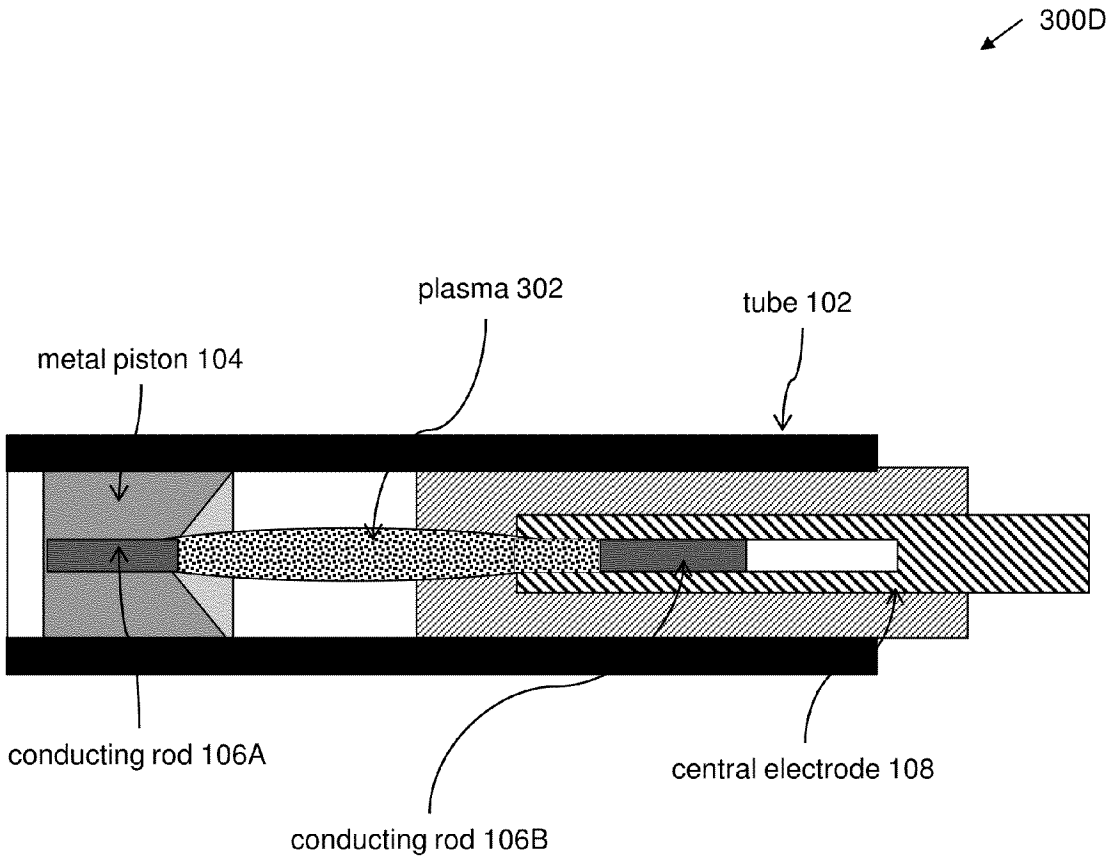
FIG. 3D illustrates conducting rod evaporation finishing with plasma density decreasing as the plasma column length increases in accordance with one embodiment.
Figure 3E:
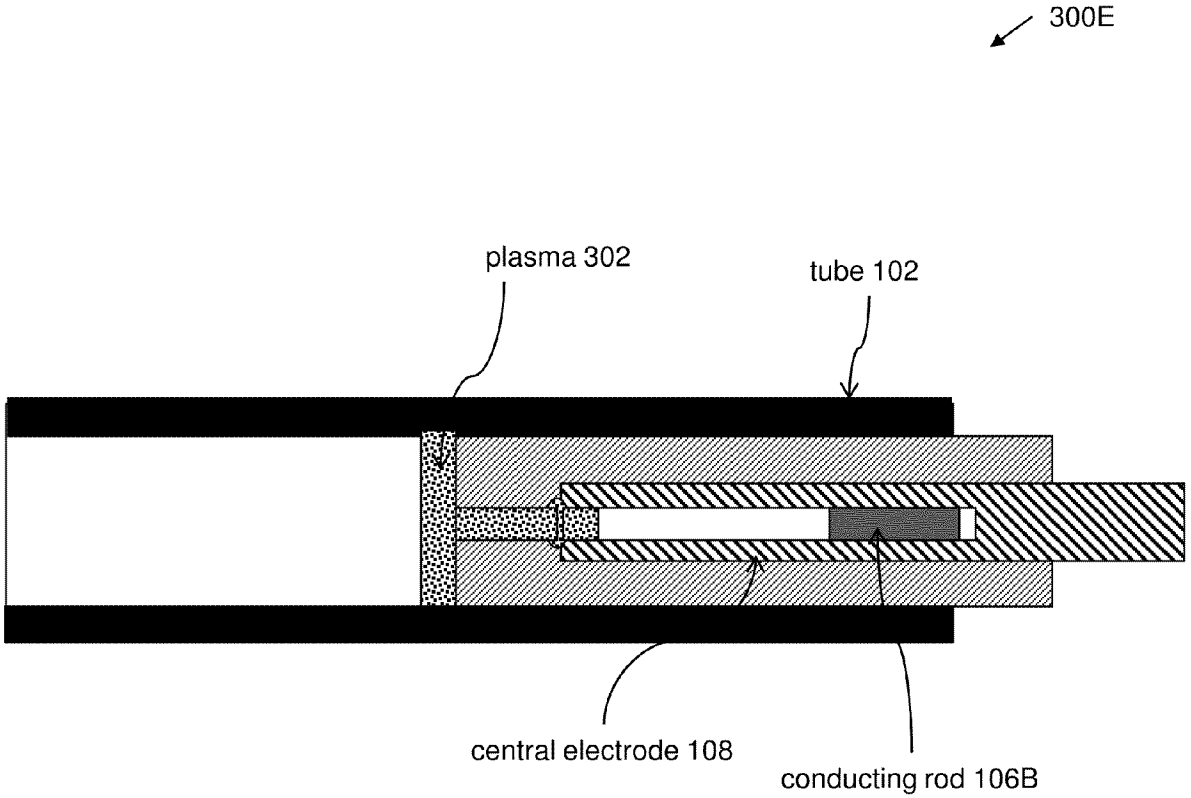
FIG. 3E illustrates once the piston has left the tube, the plasma column cannot be maintained and the plasma current shorts to tube walls in accordance with one embodiment.

FIG. 3D illustrates conducting rod 106 evaporation finishing with plasma density decreasing as plasma 302 increases in column length in accordance with one embodiment. FIG. 3E illustrates once piston 104 has left tube 102, the column of plasma 302 cannot be maintained and the current of plasma 302 shorts to wall 116 of tube 102 in accordance with one embodiment.

As can be appreciated by those of skill in the art, various embodiments of the invention in differing scales can be made to accommodate different applications. For descriptive purposes, and as an example of a motional plasma stabilizer device such as device 100 in FIG. 1, in one embodiment, tube 102 is 20 mm in diameter by 30 cm in length; piston 104 has a mass of 20 g; and the diameter of conducting rod 106 is ≈6 mm.

Figure 4:
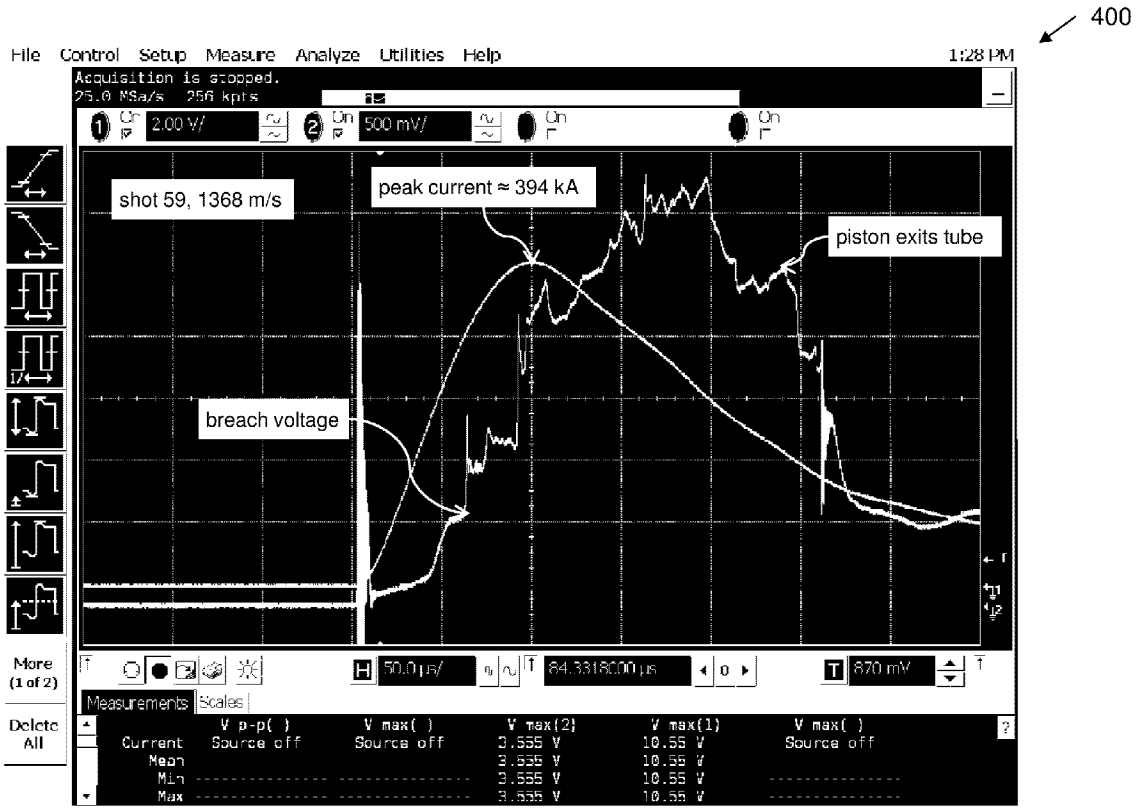
FIG. 4 illustrates a test record of current and breech voltage in accordance with one embodiment.

FIG. 4 illustrates a test record graph 400 of current and breech voltage of an experimental version of a motional plasma stabilizer device similar to FIG. 1 in accordance with one embodiment. In FIG. 4, graph 400 illustrates that the conducting rod, e.g., conducting rod 106, separated about 60 μs after the current started to flow, and the piston, e.g., piston 104, traveled about 20 cm in about 250 μs, during which time the plasma, e.g., plasma 302, was maintained in the tube, e.g., tube 102, without shorting to the tube walls, e.g., wall 116. Although the pressure within the plasma proper was not measured, measurements of the temporal development of pressure within the tube show that transient pressures of about 2000 Atm are produced for a time of roughly 100 μs. Again plasma temperatures are not measured, but are high enough to produce sufficient ionization for moderately low (≈1 mohm) electrical resistance. Presuming a perfect gas law, P=nkT, then nTt=Pt/k where P is pressure and $k=1.38\times10^{-23}$, t≈100 μs, and maximum $nTt\approx10^{20}$ keV-s/$m^3$ is indicated in the tube.

Plasma generated in accordance with the invention is initially formed well away from the walls of the barrel and is contained first by the insulator and then by the magnetic field produced by the current. Even so, the lifetime of the plasma is longer than anticipated, because various unstable modes tended to develop rapidly in the prior art. It is postulated that the plasma generated in embodiments in accordance with the invention is stabilized by the rapid acceleration of the piston, so that instability modes do not have time to develop fully.

The performance of device 100 is very sensitive to changes in the material and sizing of conducting rod 106, notch 118, insulator 110, piston 104, and central electrode 108. A strong longitudinal magnetic field imposed before the plasma initially forms might reduce the sensitivity to these changes. If a longitudinal magnetic field is to be imposed in tube 102, the metal selected should permit rapid penetration of the magnetic field. Thus, a highly conductive metal, such as copper or aluminum, or a magnetically soft material such as ordinary iron would be unsuitable.

As described above, embodiments in accordance with the invention described herein initiate very hot, dense, long-lived plasma along the central axis of the interior channel of a tube. This disclosure provides exemplary embodiments of the present invention. The scope of the present invention is not limited by these exemplary embodiments. Numerous variations, whether explicitly provided for by the specification or implied by the specification or not, may be implemented by one of skill in the art in view of this disclosure.

What is claimed is:

1. A device for generating a hot, long-lived plasma comprising:

a cylindrical metal tube having an outer diameter and an inner diameter and a central channel;

a metal piston disposed within the central channel;

a conducting central electrode, having a centrally formed cavity;

a conducting rod having an encircling notch, wherein:

a first portion of said conducting rod is attached within said metal piston, a second portion of said conducting rod having said encircling notch extends between said metal piston and said central electrode, and a third portion of said conducting rod extends within said cavity of said central electrode such that a space is formed between the end of said third portion and the back of the cavity within said central electrode; and, an insulator disposed within said central channel and surrounding said conducting central electrode and said second portion of said conducing rod, wherein application of a current to said metal tube and said central electrode causes said conducting rod to break at the location of said notch with resultant generation of a hot, long-lived plasma along a central axis of said central channel.

2. A method for generating a hot, long-lived plasma in a device having:

a cylindrical metal tube having an outer diameter and an inner diameter and a central channel;

a metal piston disposed within the central channel;

a conducting central electrode, having a centrally formed cavity;

a conducting rod having an encircling notch, wherein:

a first portion of said conducting rod is attached within said metal piston, a second portion of said conducting rod having said encircling notch extends between said metal piston and said central electrode, and a third portion of said conducting rod extends within said cavity of said central electrode such that a space is formed between the end of said third portion and the back of the cavity within said central electrode; and, an insulator disposed within said central channel and surrounding said conducting central electrode and said second portion of said conducing rod, said method comprising:

applying a current to said metal tube and said central electrode causing said conducting rod to break at the location of said notch with resultant generation of a hot, long-lived plasma along a central axis of said central channel.

* * * * *